US009168933B2

(12) United States Patent
Shimokawa

(10) Patent No.: US 9,168,933 B2
(45) Date of Patent: Oct. 27, 2015

(54) RAILWAY VEHICLE STEERING TRUCK

(71) Applicant: NIPPON STEEL & SUMITOMO METAL CORPORATION, Tokyo (JP)

(72) Inventor: Yoshiyuki Shimokawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/365,667

(22) PCT Filed: Sep. 20, 2012

(86) PCT No.: PCT/JP2012/074031

§ 371 (c)(1),
(2) Date: Jun. 16, 2014

(87) PCT Pub. No.: WO2013/094264

PCT Pub. Date: Jun. 27, 2013

(65) Prior Publication Data

US 2014/0311378 A1 Oct. 23, 2014

(30) Foreign Application Priority Data

Dec. 19, 2011 (JP) ..... 2011-277376

(51) Int. Cl.
*B61F 5/50* (2006.01)
*B61K 3/02* (2006.01)
*B61F 5/38* (2006.01)

(52) U.S. Cl.
CPC ... *B61F 5/50* (2013.01); *B61F 5/38* (2013.01); *B61K 3/02* (2013.01)

(58) Field of Classification Search
CPC ..... B61F 5/50; B61F 5/38; B61F 5/22; B61F 5/301; B61F 3/00; B61F 19/00; B61K 3/02; B61K 3/00; F16N 11/06
See application file for complete search history.

(56) References Cited

U.S. PATENT DOCUMENTS 1,723,720 A * 8/1929 Buchli ..... 105/109
1,780,464 A * 11/1930 Coppage ..... 184/3.2

(Continued)

FOREIGN PATENT DOCUMENTS

CN 2136780 6/1993
CN 2889819 4/2007

(Continued)

OTHER PUBLICATIONS

JR EAST Technical Review, No. 25, "Efforts in . . . Maintenance Technology", p. 5-8, Mar. 31, 2007.

*Primary Examiner* — Jason C Smith
(74) *Attorney, Agent, or Firm* — Clark & Brody

(57) ABSTRACT

A steering truck for steering a wheel axle of a truck has a solid lubricant application device at a position facing a flange of a wheel on the outer side of the wheel axle in the direction of travel in a truck frame. A solid lubricant is applied to freely make contact with and move away from the flange and a spring impels the solid lubricant towards the flange. A stopper restrains the solid lubricant from approaching the flange, By utilizing a forward and backward movement of the wheel axle in the travel direction caused by steering, the solid lubricant 3 makes contact only on the outer rail side toward which the wheel approaches when passing through a curved section. No contact occurs on the inner rail side from which the wheel moves away when passing through a curved section and when traveling through a straight section.

3 Claims, 3 Drawing Sheets

(a)

(b)

(56) References Cited

U.S. PATENT DOCUMENTS

| | | | | |
|---|---|---|---|---|
| 1,802,933 | A * | 4/1931 | Von Salis | 239/89 |
| 2,866,521 | A * | 12/1958 | Gibson | 184/3.2 |
| 3,204,876 | A * | 9/1965 | Elverston | 239/533.15 |
| 3,802,352 | A * | 4/1974 | Keller | 105/181 |
| 5,054,582 | A * | 10/1991 | Aracil | 184/3.2 |
| 5,251,724 | A * | 10/1993 | Szatkowski et al. | 184/3.2 |
| 5,305,853 | A * | 4/1994 | Ross et al. | 184/3.2 |
| 5,337,860 | A * | 8/1994 | Burke et al. | 184/3.2 |
| 5,358,072 | A * | 10/1994 | Szatkowski et al. | 184/3.2 |
| 5,839,335 | A * | 11/1998 | Tilley | 83/169 |
| 5,873,528 | A * | 2/1999 | Lewis et al. | 239/135 |
| 5,908,161 | A * | 6/1999 | Womac et al. | 239/583 |
| 6,142,258 | A * | 11/2000 | Chepovetsky et al. | 184/99 |
| 6,186,411 | B1 * | 2/2001 | Sich | 239/89 |
| 6,719,095 | B2 * | 4/2004 | Arens et al. | 184/3.1 |
| 6,742,624 | B2 * | 6/2004 | DiCarlo | 184/3.1 |
| 6,971,479 | B1 * | 12/2005 | Urmson et al. | 184/3.1 |
| 8,235,177 | B2 * | 8/2012 | Kawahara et al. | 184/99 |
| 8,251,182 | B2 * | 8/2012 | Yang | 184/7.4 |
| 8,445,416 | B2 * | 5/2013 | Cotter et al. | 508/125 |
| 8,584,804 | B2 * | 11/2013 | Holland | 184/3.1 |
| 2003/0101897 | A1 * | 6/2003 | Mitrovich et al. | 104/279 |
| 2005/0005815 | A1 * | 1/2005 | Forbes et al. | 105/453 |
| 2005/0022689 | A1 * | 2/2005 | Forbes et al. | 105/198.2 |
| 2005/0285408 | A1 * | 12/2005 | Eadie et al. | 291/3 |
| 2006/0054403 | A1 * | 3/2006 | Lacerda et al. | 184/3.2 |
| 2007/0012515 | A1 * | 1/2007 | Murphy | 184/3.2 |
| 2007/0186803 | A1 * | 8/2007 | Rodet et al. | 105/453 |
| 2011/0259670 | A1 * | 10/2011 | Amilien et al. | 184/6.22 |
| 2011/0290589 | A1 * | 12/2011 | Oldknow et al. | 184/45.2 |
| 2012/0037455 | A1 * | 2/2012 | Bennstedt | 184/3.2 |
| 2014/0174318 | A1 * | 6/2014 | Reese et al. | 105/226 |
| 2014/0261063 | A1 * | 9/2014 | Roudiere et al. | 105/168 |
| 2014/0310908 | A1 * | 10/2014 | Shimokawa | 15/256.5 |
| 2014/0311378 | A1 * | 10/2014 | Shimokawa | 105/181 |
| 2014/0339022 | A1 * | 11/2014 | Bushen | 184/3.2 |
| 2015/0114252 | A1 * | 4/2015 | Sato et al. | 105/199.1 |

FOREIGN PATENT DOCUMENTS

| | | |
|---|---|---|
| CN | 201179875 | 1/2009 |
| JP | 49-40594 | 11/1974 |
| JP | 63-259231 | 10/1988 |
| JP | 04-113968 | 4/1992 |
| JP | 06-247301 | 9/1994 |
| JP | 7-4238 | 1/1995 |
| JP | 27-10014 | 2/1998 |
| JP | 10-181600 | 7/1998 |

* cited by examiner (a)

(b)

(a)

(b)

RAILWAY VEHICLE STEERING TRUCK

TECHNICAL FIELD

The present invention relates to a railway vehicle steering truck which steers a wheel axle of a truck, and in particular, the present invention relates to a railway vehicle steering truck which is able to apply a lubricant in an optimal state to a flange throat region of a wheel in order to reduce wear, when passing through a curved section.

BACKGROUND ART

When a railway vehicle passes through a curved section having a small radius of curvature, a large lateral load is applied between a wheel and a rail. Thus, in a section with a sharp curve, a flange of a wheel on an outer rail side undergoes wear at a leading axle, while a side wear occurs on a rail side.

Accordingly, technologies were developed for reducing wear on a flange of a wheel by applying a lubricant to a flange throat region of a wheel by pressing a solid lubricant, to enhance a state of lubrication of areas of contact between a flange of a wheel and a rail (e.g., Patent Reference 1 and Non-Patent Reference 1).

For example, in Non-Patent Reference 1, it was shown that deployment of a solid lubricant to a flange of a wheel from on-board a railway vehicle is effective in reducing wear on a flange throat region of a wheel.

However, FIG. 3 of Non-Patent Reference 1 only shows a photograph in which a solid lubricant presses against a flange of a wheel, and there is no discussion about a detailed structure for pressing the solid lubricant against the flange of the wheel.

In a hypothetical case wherein a constant pressure system employs a spring to press a solid lubricant against a flange of a wheel, there is a problem in that an increasing amount of costly lubricant is consumed, because the solid lubricant is constantly pressed against the flange of the wheel.

In particular, in the case of a steering truck, the solid lubricant is pressed against the flange of the wheel when traveling through a straight section (See FIG. 3 (*a*)) as well as when passing through a curved section (see FIGS. 3 (*b*) and (*c*)). Therefore, if a solid lubricant is deployed on an outer side of a truck frame in the direction of travel, the pressing force on the wheel flange increases at the outer rail side (see FIG. 3 (*b*)) which the wheel approaches while passing through a curved section, and wear on the solid lubricant is greater than in the case of an ordinary truck.

In FIG. 3, Reference Numeral 1 is a truck frame, 2 is a wheel axle formed from a wheel 2*a* and an axle 2*b*, and 3 is a solid lubricant applied to an outer side in the direction of travel of the truck frame 1 so as to freely make contact with and move away from a flange 2*aa* of the wheel 2*a*. Reference Numeral 4 is a spring which presses the solid lubricant 3 against the flange 2*aa* of the wheel 2*a*, 5 is an axle box, 6 is an axle spring, and R is a rail.

In Patent Reference 1 there is disclosed a movable technology for reducing wheel flange wear, wherein a solid lubricant is formed integrally with a brake shoe, and the surface characteristics of the flange throat of the wheel are improved by transferring the lubricant to the flange throat region of the wheel when the brake is applied.

However, in the technology disclosed in Patent Reference 1, transfer of the lubricant to the flange throat of the wheel is limited to a period when the brake is applied, so the amount of lubricant consumed is lower than when the lubricant is constantly being pressed against, but there remains a problem in that the lubrication performance is not sufficient.

PRIOR ART REFERENCES

Patent Reference

Patent Reference 1: Japanese Patent Application Kokai Publication No. S63-259231

Non-Patent Reference

Non-Patent Reference 1: *JR EAST Technical Review*, No. 25, "Efforts in Research and Development Related to Maintenance Technology," p. 5-8.

SUMMARY OF THE INVENTION

Problems to be Solved by the Invention

One problem which the present invention aims to solve is that of a consumption of a large amount of lubricant resulting from a constant pressing against the lubricant not only when passing through curved sections, but also when traveling through straight sections, in cases where a solid lubricant is pressed against a flange of a wheel by a spring. Another problem which the present invention aims to solve is that of an insufficient lubrication performance in cases where a solid lubricant is formed integrally with a brake shoe, and the lubricant is transferred to the flange throat region of the wheel when the break is applied, because the transfer of lubricant to the flange throat region of the wheel is limited to a period when the brake is applied.

Means for Solving this Problem

The present invention has as its object to maintain a necessary and sufficient lubricating action while at the same time reducing the amount of lubricant that is consumed. In order to achieve this object, a constant pressure system employs a spring to press on the solid lubricant, while a forward and backward movement of the wheel axle of the steering truck is activated in the direction of travel, and a solid lubricant is applied by pressing it only on an axle position on an outer track side while passing through a curved section.

The railway vehicle steering truck according to the present invention is a steering truck designed to make it possible to steer a wheel axle of the truck, the steering truck comprising:

a solid lubricant application device disposed at a position facing a flange of a wheel on the outer side of the wheel axle in the direction of travel in a truck frame of the steering truck, the solid lubricant application device comprising:

a solid lubricant applied so as to freely make contact with and move away from the flange of the wheel;

a pressure spring which impels the solid lubricant towards the flange of the wheel; and a stopper for restraining the solid lubricant from approaching the flange of the wheel, so that by utilizing a forward and backward movement of the wheel axle in the travel direction caused by steering, the solid lubricant makes contact only on the outer rail side toward which the wheel approaches when passing through a curved section, whereas not making contact on the inner rail side from which the wheel moves away when passing through a curved section and when traveling through a straight section.

The steering truck according to the present invention is able to maintain a necessary and sufficient lubricating action, while reducing wear on the lubricant, because it impels the solid lubricant only towards the flange of the wheel on the outer rail side which the wheel approaches, by utilizing a forward and backward movement of the wheel axle in the travel direction caused by steering, while passing through a curved section.

Advantageous Effects of the Invention

According to the present invention, a required amount of solid lubricant is applied by impelling it towards the flange throat region of the wheel on the outer rail side only when passing through a curved section where the wheel flange and the rail side portion come into contact, by utilizing a forward and backward movement of the wheel axle of the steering truck in the travel direction of the railway vehicle in the curved section. This makes it possible to maintain a necessary and sufficient lubricating action, while reducing wear on the lubricant.

Because the present invention comprises a constant pressure-type solid lubricant application device, the manufacturing cost is lower than a movable solid lubricant application device.

BRIEF DESCRIPTION OF THE DRAWINGS

FIG. 1 (*b*) is a drawing of a state in which a solid lubricant is impelled against a flange of a wheel.

FIG. 2 (*a*) is a drawing of the outer side rail where the wheel approaches the outer side of the truck frame in the direction of travel. FIG. 2 (*b*) is a drawing of the inner side rail where the wheel moves away from the outer side of the truck frame in the direction of travel.

FIG. 3 (*a*) illustrates a case when traveling through a straight section. FIG. 3 (*b*) is a drawing of the outer rail side where the wheel approaches the outer side of the truck frame in the direction of travel when passing through a curved section. FIG. 3 (*c*) is a drawing of the inner rail side where the wheel moves away from the outer side of the truck frame in the direction of travel when passing through a curved section.

PREFERRED EMBODIMENT

The object of the present invention, which is to maintain a necessary and sufficient lubricating action while at the same time reducing the amount of lubricant that is consumed, is achieved by a design such that the solid lubricant makes contact only on the outer rail side toward which the wheel flange approaches when passing through a curved section, whereas not making contact on the inner rail side from which the wheel flange moves away when passing through a curved section and when traveling through a straight section.

EXAMPLE

An embodiment of the present invention is described below, using FIG. 1 and FIG. 2.

Figure 1:
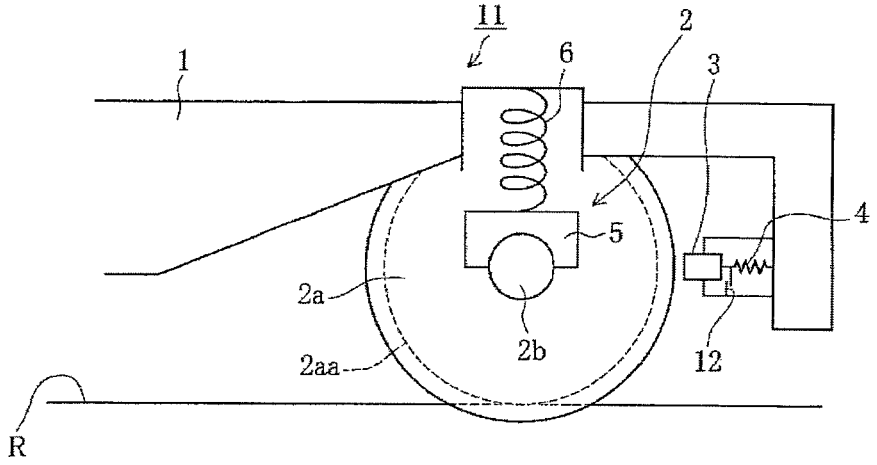
FIG. 1 (*a*) is a drawing illustrating the essential elements of the steering truck according to the present invention when traveling through a straight section.
Figure 1:
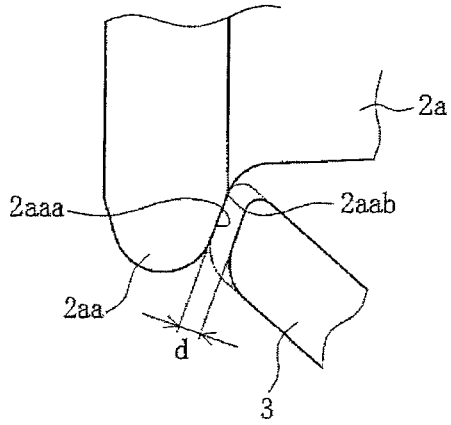

FIG. 1 is a drawing illustrating the essential elements of the steering truck according to the present invention when traveling through a straight section. FIG. 2 is a drawing illustrating the essential elements of the steering truck according to the present invention when passing through a curved section.

Reference Numeral 11 is a steering truck of the present invention which employs a steering apparatus to move a wheel axle 2 forward and backward in the travel direction of the vehicle when passing through a curved section. A solid lubricant 3 is attached to a truck frame 1 in a position facing a flange 2*aa* of a wheel 2*a*, and moves freely to come into contact with and to move away from the flange 2*aa*, for example.

According to the present invention, the solid lubricant 3 is deployed at the outer side portion of the truck frame 1 in the direction of travel, so as to make it possible to apply the lubricant to an area extending from a side surface 2*aaa* of the flange 2*aa* of the wheel 2*a* to a flange throat region 2*aab*, as shown in FIG. 1 (*b*).

In the present invention, deployment of the solid lubricant 3 so as to make it possible to apply the lubricant to an area extending from the side surface 2*aaa* of the flange 2*aa* of the wheel 2*a* to the flange throat region 2*aab* is based on a presentation at the $11^{th}$ Railroad Technical Combined Symposium (J-RAIL2004) titled "Investigations of Wheel Radius Differential Characteristics Resulting from Mutual Wear Between a Rectified Bowed Tread Surface and a Rail."

According to the above-mentioned presentation, the flange throat region becomes worn in curved sections with a radius of less than 400 m, because wear was reported to have occurred in the flange throat region in curved sections with a radius of 400 m. In the description below, a curved section with a radius of less than 400 m is referred to as a sharp curve.

In addition, the solid lubricant 3 disposed in the above position is continuously impelled towards the flange 2*aa* of the wheel 2*a* by a pressure spring 4. That is to say, the solid lubricant application device employed in the present invention is a constant pressure spring system which is advantageous from a cost standpoint.

However, if a constant pressure type of solid lubricant application device is installed by itself in the steering truck 11, the pressing force of the solid lubricant 3 on the flange 2*aa* on side where the wheel 2*a* approaches is greater than in a typical truck, so wear readily occurs when passing through a curved section.

The purpose for applying the lubricant to an area extending from the side surface 2*aaa* of the flange 2*aa* of the wheel 2*a* to the flange throat region 2*aab* is to improve the lubrication state at a point of contact between the flange 2*aa* of the wheel 2*a* and the rail R, thereby reducing wear in an area extending from the flange 2*aa* to the flange throat region 2*aab*. Therefore, the lubricant needs to be applied only to the flange 2*aa* of the wheel 2*a* on the outer rail side of a curved section where the rail R and the flange 2*aa* of the wheel 2*a* come into contact.

On the other hand, in the steering truck 11, the wheel axle 2 moves forward and backward in the direction of travel depending on the radius of curvature only when passing through a curved section. Therefore, the solid lubricant 3 needs to be impelled towards the flange 2*aa* of the wheel 2*a* on the outer rail side only when the wheel axle 2 moves forward and backward in the direction of travel when passing through a curved section.

Accordingly, the present invention is designed to impel the solid lubricant 3 only towards the flange 2*aa* of the wheel 2*a* on the outer rail side when passing through a curved section, by activating a forward and backward movement of the wheel axle 2 of the steering truck in the direction of travel when passing through a curved section.

In other words, according to the present invention, there is provided a stopper 12 for restraining the solid lubricant 3 from approaching the flange 2*aa*, so that the solid lubricant 3 does not make contact with the flange 2*aa* of the wheel 2*a* when traveling through a straight section, as shown in FIG. 1.

Figure 2:
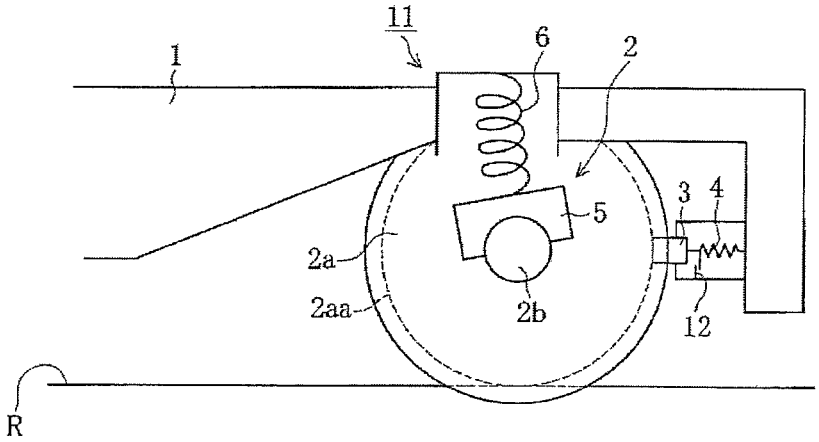
FIG. 2 is a drawing illustrating the essential elements of the steering truck according to the present invention when passing through a curved section.
Figure 2:
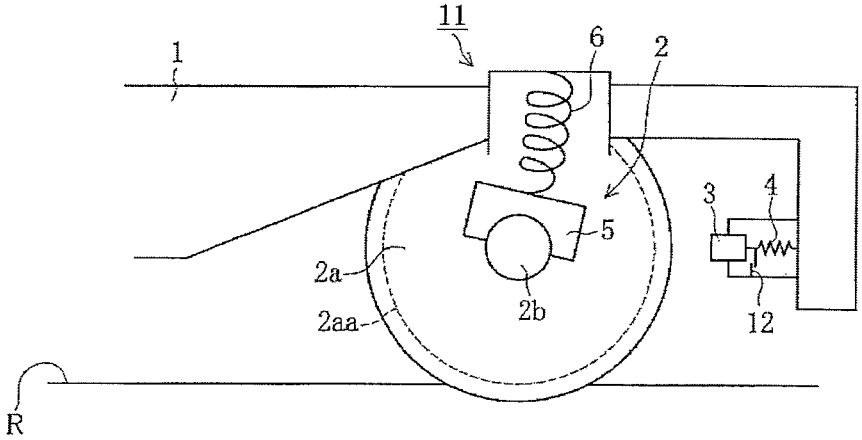
Figure 3:
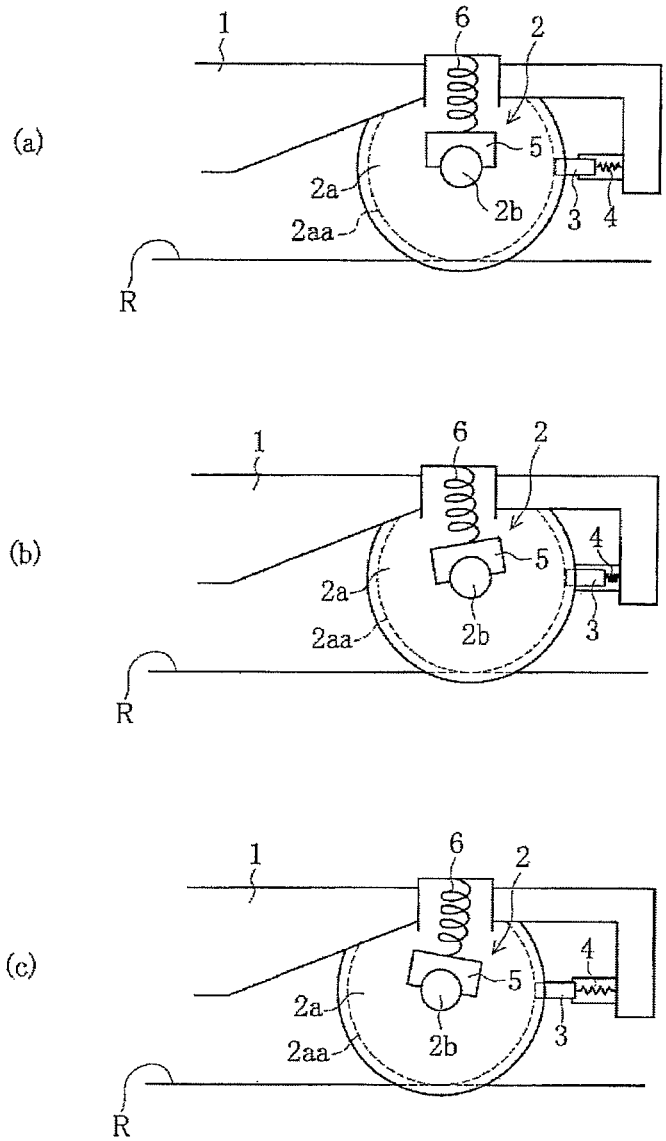
FIG. 3 is a drawing illustrating the essential elements of a steering truck equipped with a constant pressure spring type solid lubricant pressing device according to the prior art.

For example, in the examples shown in FIG. 1 and FIG. 2, the spring 4 has the base end side being affixed and the forward end to which the solid lubricant 3 is attached, and the stopper 12 prevents an extension of the spring 4 at the forward end side of the spring 4 to thereby restrain the solid lubricant 3 from approaching the flange 2*aa*.

When this happens, a gap d between the solid lubricant 3 and the flange 2*aa* of the wheel 2*a* cannot be compensated only by the radius differential of the wheel 2*a*. It is therefore desirable that the solid lubricant 3 makes contact with the flange 2*aa* of the wheel 2*a* only in sharp curves where the area of contact between the wheel 2*a* on the outer rail side of the leading axle 2 and the rail R reaches the flange 2*aa* of the wheel 2*a*.

Accordingly, it becomes possible to reduce the wear on the solid lubricant 3, because the time when the solid lubricant 3 is impelled towards the flange 2*aa* of the wheel 2*a* is limited only to the time when passing through sharp curves where wear develops in the throat region 2*aab* of the flange 2*aa*.

The solid lubricant 3 may be disposed in any position where it is possible for the solid lubricant 3 to be impelled only against the flange 2*aa* of the wheel 2*a* on the outer rail side when passing through a curved section. However, it is desirable from the standpoint of maintenance to install the solid lubricant 3 in a position as horizontal and parallel to the direction of height of the rail R as possible, in a position at a height as close to the center of the axle 2*b* as possible.

As shown in FIG. 1, when the steering thick 11 of the present invention having the above-described configuration travels through a straight section, the gap d is present between the solid lubricant 3 and the flange 2*aa* of the wheel 2*a*, so the solid lubricant 3 and the flange 2*aa* do not come into contact.

On the other hand, when passing through a sharp curve, for example, contact occurs only on the outer rail side toward which the flange 2*aa* of the wheel 2*a* approaches (see FIG. 2 (*a*)), due to the forward and backward movement of the wheel axle 2 in the travel direction caused by steering, so as apply the lubricant only to the flange 2*aa* of the wheel 2*a* on the outer rail side. At this time, there is no contact with the inner rail side from which the wheel 2*a* moves away (see FIG. 2 (*b*)).

That is to say, according to the steering truck 11 of the present invention, the lubricant is applied by impelling the solid lubricant 3 only towards the flange 2*aa* of the wheel 2*a* which is positioned on the outer rail side when passing through a sharp curve, and the solid lubricant 3 does not come into contact with the flange 2*aa* of the wheel 2*a* on the inner rail side and when traveling through a straight section. It is therefore possible to effectively reduce wear on the solid lubricant 3.

In addition, when passing through the above-described sharp curve, the impelling of the solid lubricant 3 operates only on the flange 2*aa* of the wheel 2*a* positioned on the outer rail side, and the movement of the wheel axle 2 of the steering truck is activated, so a separate cylinder or the like is not used. Therefore, the configuration of the system itself is simple and maintenance is easy.

The present invention is not limited to the above-described example, and the preferred embodiment may, of course, be advantageously modified within the scope of the technical ideas recited in the claims.

For example, in the example shown in FIG. 1 and FIG. 2, the solid lubricant 3 is restrained from approaching the flange 2*aa* by preventing an expansion of the spring 4 at the forward end side of the spring 4 which is affixed at a position on the base end side. However, any configuration is acceptable, as long as it is able to restrain the solid lubricant 3 from approaching the flange 2*aa*.

The steering system used in the steering truck according to the present invention can be either an active forced steering system or a semi-forced steering system. An active forced steering system employs an air pressure-type, hydraulic-type, or electric-type actuator to supply energy from outside of the system to actively steer the wheel axle while controlling it. A semi-forced steering system employs a mechanical mechanism such as a link to couple the vehicle body, the truck, and the wheel axles, and employs bogie displacement which occurs between the vehicle body and the truck as a driving force while passing through a curved section.

Explanation Of The Reference Numerals

1 Truck frame
2 Wheel axle
2*a* Wheel
2*aa* Flange
2*b* Axle
3 Solid lubricant
4 Spring
11 Steering truck
12 Stopper

The invention claimed is:

1. A railway vehicle steering truck designed to make it possible to steer a wheel axle of the truck, the steering truck comprising:

a solid lubricant application device disposed at a position facing a flange of a wheel on the outer side of the wheel axle in the direction of travel in a truck frame of the steering truck, the solid lubricant application device comprising:

a solid lubricant applied so as to freely make contact with and move away from the flange of the wheel;

a pressure spring which impels the solid lubricant towards the flange of the wheel; and a stopper for restraining the solid lubricant from approaching the flange of the wheel, so that by utilizing a forward and backward movement of the wheel axle in the travel direction caused by steering, the solid lubricant makes contact only on the outer rail side toward which the wheel approaches when passing through a curved section, whereas not making contact on the inner rail side from which the wheel moves away when passing through a curved section and when traveling through a straight section.

2. The railway vehicle steering truck according to claim 1, wherein the solid lubricant is installed in a position as horizontal and parallel to the direction of height of the rail as possible, in a position at a height as close to the center of the axle as possible.

3. The railway vehicle steering truck according to claim 1, wherein a gap between the solid lubricant and the flange of the wheel cannot be compensated only by the radius differential of the wheel, and wherein the solid lubricant makes contact with the flange of the wheel only in sharp curves where the area of contact between the wheel on the outer rail side of the leading axle and the rail reaches the flange of the wheel.

* * * * *